United States Patent [19]

Foster

[11] Patent Number: 4,938,243

[45] Date of Patent: Jul. 3, 1990

[54] ICE FISHING SHELTER

[76] Inventor: Michael R. Foster, 1011 S. 10th St., LaCrosse, Wis. 54601

[21] Appl. No.: 332,155

[22] Filed: Apr. 3, 1989

[51] Int. Cl.[5] ..... E04H 15/00

[52] U.S. Cl. ..... 135/105; 135/109; 135/901; 43/1

[58] Field of Search ..... 135/104, 109, 105, 901, 135/DIG. 9; 43/1

[56] References Cited

U.S. PATENT DOCUMENTS

| | | | |
|---|---|---|---|
| 2,811,977 | 11/1957 | McClish . | |
| 2,938,524 | 5/1960 | Benson | 135/105 |
| 3,121,439 | 2/1964 | Moltchan . | |
| 3,174,493 | 3/1965 | Gruenberg . | |
| 3,266,503 | 8/1966 | Hoiness et al. . | |
| 3,874,398 | 4/1975 | Hendrickson . | |
| 4,003,181 | 1/1977 | Robinson et al. | 135/105 |
| 4,067,346 | 1/1978 | Husted | 135/901 |
| 4,067,347 | 1/1978 | Lipinski | 135/901 |
| 4,252,136 | 2/1981 | Kruczynski | 135/901 |
| 4,632,138 | 12/1986 | Irwin . | |
| 4,683,672 | 8/1987 | Davis . | |
| 4,827,958 | 5/1989 | Cantwell et al. | 135/105 |

*Primary Examiner*—Carl D. Friedman
*Assistant Examiner*—Caroline D. Dennison
*Attorney, Agent, or Firm*—Warren A. Sturm

[57] ABSTRACT

A foldable shelter is disclosed having a flexible skin with an inner U-shaped support frame and a pair of resilient top support members attached to the exterior of the top of the skin.

7 Claims, 3 Drawing Sheets

ICE FISHING SHELTER

BACKGROUND OF THE INVENTION

1. Field of the Invention

My invention relates generally to collapsible, portable shelters and is more particularly directed to a lightweight collapsible shelter of the kind utilized by ice fisherman and the like.

2. Prior Art

The prior art is replete with shelters of various size, construction, and shape, the closest of which is illustrated in the following listing of United States Patents that have been collected in the course of evaluating my invnetion. No one, or any reasonable combination of the references listed below are believed to anticipate my novel and unobvious invention, as will be set forth below.

The following is a list of such patents:

| U.S. Pat. No. | Patentee | Issue Date | Title |
|---|---|---|---|
| 2,811,977 | McClish | Nov. 5, 1957 | SHELTER SEAT |
| 3,121,439 | Moltchan | Feb. 18, 1964 | FOLDABLE CANOPY |
| 3,174,493 | Gruenberg | Mar. 23, 1965 | BEACH OR POOL-SIDE SHIELD |
| 3,266,503 | Hoiness et al | Aug. 16, 1966 | COLLAPSIBLE SHELTER |
| 3,874,398 | Hendrickson | Apr. 1, 1975 | LIGHTWEIGHT PORTABLE ICE FISHING SHELTER FRAME |
| 4,632,138 | Irwin | Dec. 30, 1986 | PORTABLE SHELTER |
| 4,683,672 | Davis | Aug. 4, 1987 | COLLAPSIBLE GAME BLIND |

Of the patents listed above, U.S. Pat. No. 3,874,398 is of interest for its showing a collapsible shanty in which a collapsible frame is disposed around or within a canvas structure and includes a lateral spacer at the top from which the top of the canvas structure is suspended; U.S. Pat. Nos. 3,174,493 and 3,266,503 are of interest in their showings of the use of helical coiled springs to provide a hinge function.

BRIEF DESCRIPTION OF THE INVENTION

My invention is comprised of an envelope or skin of suitable flexible material, that is impervious to the weather conditions that are likely to be encountered, which is supported from within and without by a plurality of collapsible, foldable frames that are disposed to coact through the envelope material to support and maintain the shelter in its intended parallelepiped shape when properly asseembled.

The skin or envelope is typically a right rectangular parallelepiped configuration which may include a pair of openings in the bottom for drilling holes through, for example, the ice layer on a lake and a side access opening which may, for convenience, be zippered, in one side wall. The rectangularly shaped collapsible frame members are hingedly connected together at adjacent end portions so as to form a generally U-shaped frame structure that is open at the top and is normally disposed inside of the skin or envelope of the structure. Each of the collapsible rectangular frames may further be folded in half by providing hinge mechanisms at the center of the side portions. The skin, or envelope is detachably connected along the top end portions of the frame members and at other appropriate locations as, for example, the adjacent end portions of the frame members. The top center of the skin or envelope includes a loop for receiving a pair of flexible support members which are dimensioned so as to cause upward flexing thereof when opposite ends are disposed in pockets, therefor, disposed at the top end corneers of the skin or envelope adjacent the top edges of the end portions of the vertically-disposed frame members. With all of the members described above in place, the structure may easily be lifted as it will retain the parallelepiped shape. When desired or necessary, the structure, including the skin or envelope may be collapsed and folded into a compact size so that transportation or storage becomes easier from the standpoint of requiring space for the shelter.

It is an object of my invention to provide a lightweight collapsible shelter.

Another object of my invention is to provide a rigid collapsible shelter structure.

It is a still further object of my invention to provide an improved portable, collapsible shelter for use in hunting and fishing.

These and other objects and advantages of my invention will become apparent from a consideration of the appended specification, claims and drawings in which;

FIG. 2 is a perspective sketch of an erected internal frame for;

DETAILED DESCRIPTION OF THE INVENTION

Figure 1:
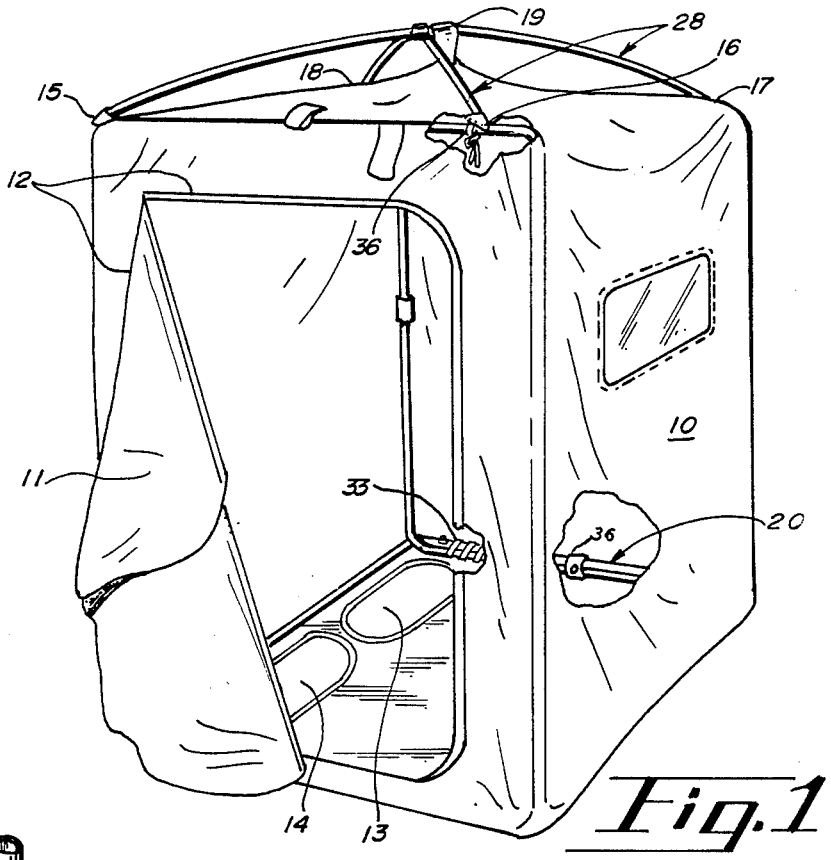
FIG. 1 is a perspective sketch (partly broken away) of an erected shelter embodying the principles of my invention.
Figure 5:
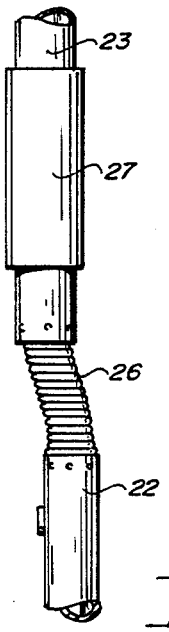
FIG. 5 is an enlarged fragmentary view of a portion of FIG. 4 illustrating the nature of a folding hinge spring connector.

Referring now to the drawings in which like elements have been identified by like reference characters, my shelter is shown comprised of an envelope or skin 10 of generally right parallelepiped shape and configuration and including top, bottom, end and side portions. One of the end portions is provided with a flap or door 11 that is suitably disposed on a zipper 12 for easy ingress and egress to the shelter. The bottom contains a pair of fishing holes or apertures 13 and 14 through which occupants may practice their piscatorial arts without interference from the elements. Along the top outside edges of the end portions of envelope 10 are disposed a plurality of pockets 15, 16, 17 and 18 which will be used, in conjunction with a top support and holding loop 19, disposed approximately the center of top portion of envelope 10, for purposes to be explained below.

Figure 6:
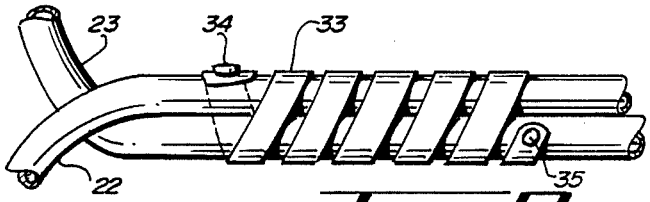
FIG. 6 is an enlarged fragmentary view of a portion of FIG. 2 showing the configuration of a hinge utilized to interconnect adjacent collapsible frames in the internal frame.

An internal frame 20 of generally U-shaped configuration having a pair of vertical end frames and a horizontal bottom frame portion, each of the end and bottom frames are shown to be identical in shape, hingedly connected together at adjacent end portions at the bottom thereof and comprised of U-shaped halves 22 and 23 that are interconnected by a helical spring 26 extending into the open ends and retained in position by friction or other suitable fastening arrangements, the structure being maintained in a rigid rectangular shape by the positioning of a slideable sleeve 27 therebetween and over spring 26. Adjacent end portions of the individual rectangular elements are rotatably connected by hinges 33 shown, as for example, in FIG. 6, as comprising a helically wound tape having one end connecting to the end member of one frame through screw 34 and the other end connected to the end portion of the other frame through screw 45. The elements of frame 20 may be comprised of a suitable rigid material, such as EMT, EPT or other tubing that is weather resistant and rigid under normal conditions.

A pair of top support members 28 are comprised of tubes 29 and 30, connected together at their centers through a suitable socket 31 that may be disposed on either tube 28 or 29 so that the elongated support structure 28 may be quickly assembled and installed in place as will be explained below.

Ties 36 may be provided at desired locations as may prove necessary to maintain envelope 10 in a desired relationship with frame 20 and to enhance the rigidity of the structure when assembled in an erected position.

OPERATION

Figure 2:
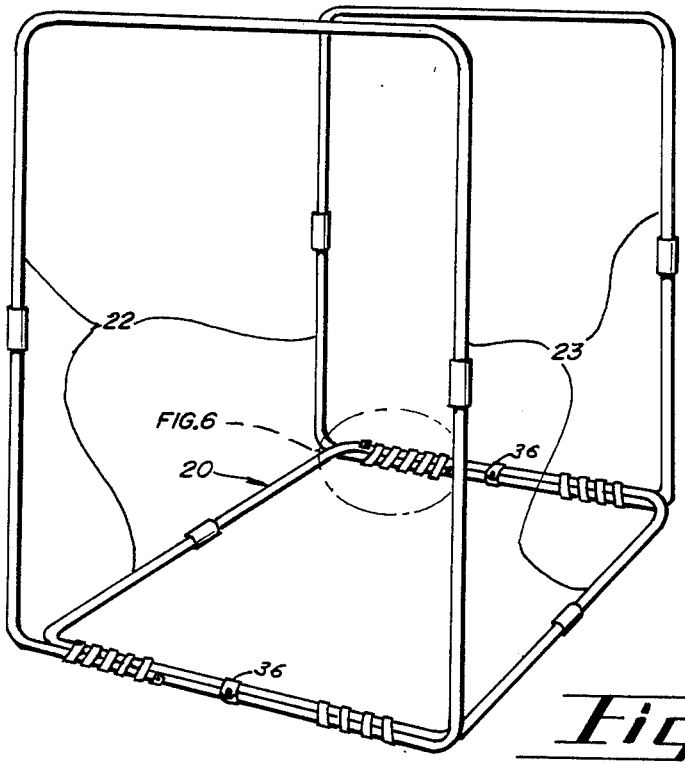
Figure 3:
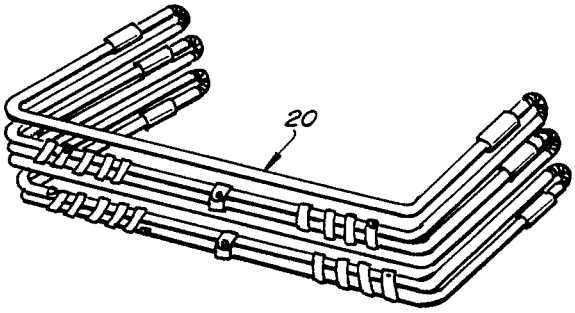
FIG. 3 is a perspective sketch of a folded internal frame.
Figure 4:
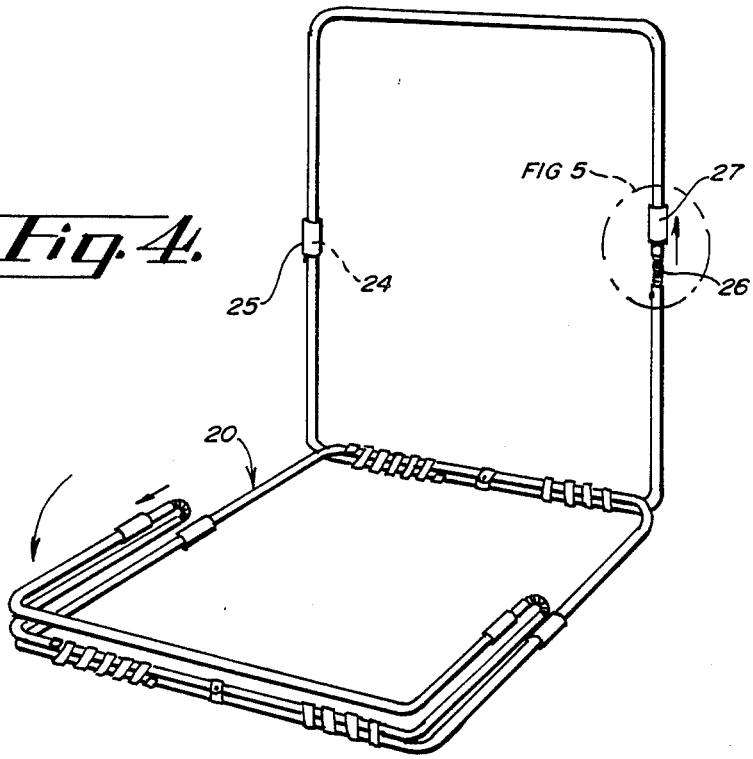
FIG. 4 is a perspective sketch of a partially erected internal frame.
Figure 7:
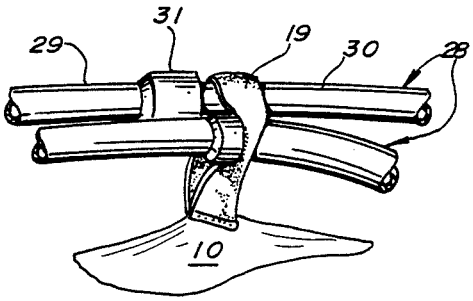
FIG. 7 is a fragmentary view illustrating the central portion of the support structure for the top of the skin or envelope of my shelter.
Figure 8:
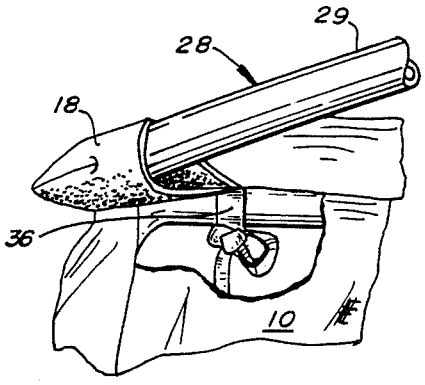
FIG. 8 illustrates the remainder of the structure utilized for the top skin support.

In one mode of operation, frame 20 is disposed within envelope 10 such that the horizontal portion, as illustrated in FIGS. 2 and 4, is disposed over the bottom portion of envelope 10. As the individual rectangular frames are unfolded and locked into their extended positions, frame 20 is slowly erected into its normal operating position, as shown in FIG. 2, within envelope 10. In this position, envelope 10 is attached to the ends of the top portions of frame 20 and the lower portion may likewise be attached to the ends of the lower ends of the frames of frame 20 through tie members 36 to maintain envelope 10 in the general position indicated on FIG. 1. At this time, the top support tubes 28 are disposed through loop 19 and one is disposed intermediate pockets 15 and 17 on the diagonally opposite ends of the top portion of envelope 10 and the other of the tubes is extended intermediate pockets 16 and 18 at the other diagonally opposite top corners of envelope 10. Support tubes 28 are dimensioned so that, when in the position indicated on FIG. 1, is attained, they will flex upwardly and provide a spring support for the center of the top of envelope 10, while simultaneously maintaining an outward force on the top two end portions of frame 20 and the adjacent ends of envelope 10 so as to effect and maintain a structural rigidity which permits ease of transportation from one location to another in the erected state.

When it is desired to transport my shelter in a compact package, the top support tubes 28 are removed, and each of the individual frame elements of U-shaped frame 20 are folded as by repositioning sleeve 27 to permit each of the elements to be folded upon itself with the skin or envelope 10 retained thereon, and while not shown in the drawings, the entire assemblage will include envelope 10 so as to permit easy unfolding and erection into the completed rigid structure.

Envelope 10 may be comprised of suitable weatherproof material, such as tent canvas, plastic or the like.

I claim:

1. A foldable shelter comprising, in combination;

a flexible skin having a parallelepiped configuration including top, bottom, ends and sides;

a U-shaped support frame for said skin comprised of vertical end frames and a horizontal bottom frame dimensioned to be and disposed within said skin coincident with said bottom and ends of said skin; and a pair of elongated flexible resilient support members having a longitudinal dimension in excess of the diagonal dimensions of the top of said skin, said skin including means for receiving the ends of said support members and support means extending upwardly of the center of said top whereby said skin is maintained in said parallelepiped configuration and suspended from the midsection of said support members.

2. The apparatus of claim 1 in which the vertical and horizontal frames of the U-shaped support frame are foldable.

3. The apparatus of claim 1 in which adjacent sides of the vertical frames and the horizontal frame are hingedly interconnected by a helically wound tape.

4. The apparatus of claim 2 in which adjacent sides of the vertical frames and the horizontal frame are hingedly interconnected by a helically wound tape.

5. The apparatus of claims 2, 3 or 4 in which the vertical and horizontal frames of the U-shaped support frame are hinged at their midsections to permit folding thereof.

6. The apparatus of claim 5 in which the hinge at the midpoints of the vertical and horizontal frames is comprised of a helical spring and a sliding sleeve is disposed for positioning over and away from the helical spring connector.

7. The apparatus of claim 1 in which at least the top ends of the vertical frames on the U-shaped support frame and the ends of the top of the flexible skin are connected.

* * * * *